US006032005A

United States Patent [19]

Kyung et al.

[11] Patent Number: 6,032,005

[45] Date of Patent: Feb. 29, 2000

[54] METHOD FOR CLEANING THE CONTACT CHARGER OF AN ELECTROPHOTOGRAPHIC APPARATUS

[75] Inventors: Myung-Ho Kyung, Suwon; Bum-Chae Chung, Seongnam, both of Rep. of Korea

[73] Assignee: SamSung Electronics Co., Ltd., Kyungki-do, Rep. of Korea

[21] Appl. No.: 08/777,148

[22] Filed: Dec. 30, 1996

[30] Foreign Application Priority Data

Dec. 30, 1995 [KR] Rep. of Korea ..... 95/67752

[51] Int. Cl.[7] ..... G03G 21/00

[52] U.S. Cl. ..... 399/100; 399/176; 399/50; 399/55

[58] Field of Search ..... 399/175, 176, 399/359, 100, 16, 18–21, 50, 55; 361/225

[56] References Cited

U.S. PATENT DOCUMENTS 5,253,022 10/1993 Takeuchi et al. .
5,532,795 7/1996 Tatsumi et al. .
5,557,375 9/1996 Nagayasu et al .
5,572,293 11/1996 Kituchi et al. ..... 399/357
5,608,499 3/1997 Tanaka ..... 399/359 X
5,629,755 5/1997 Ohtsuka ..... 399/176

*Primary Examiner*—R. L. Moses
*Attorney, Agent, or Firm*—Robert E. Bushnell, Esq.

[57] ABSTRACT

Disclosed is a method for cleaning the contact charger of an electrophotographic apparatus including a photosensitive (photoconductive) drum, developing means, transfer means and main motor, which comprises the steps of applying a charging voltage of a specified level to the contact charger to make the surface of the photosensitive drum keep a surface potential of a given level during rotation of the main motor, cutting off the charging voltage applied to the contact charger and developing voltage applied to the developing means after a specified time so as to transfer the toner of opposite polarity attached to the contact charger to the photosensitive drum, and applying a negative transfer voltage to the transfer means so as to transfer the toner of opposite polarity transferred to the photosensitive drum to a sheet of paper.

8 Claims, 5 Drawing Sheets

METHOD FOR CLEANING THE CONTACT CHARGER OF AN ELECTROPHOTOGRAPHIC APPARATUS

BACKGROUND OF THE INVENTION

1. Field of the Invention

The present invention concerns an electrophotographic apparatus, and more particularly a method for cleaning the contact charger of an electrophotographic apparatus contaminated by toner charged with opposite polarity.

2. Description of the Related Art

The electrophotographic apparatus is to produce an image according to a video signal in a copier, laser beam printer, facsimile machine, etc. The laser beam printer performs the printing work through the steps of charging, exposing, developing, transferring, fixing, and discharging. Conventionally used is the Scotron method to charge the photosensitive drum, which method employs a thin wire applied with a high voltage to generate charges attached to the surface of the photosensitive drum. This method suffers such drawbacks that the surface potential of the photosensitive drum comes to have too small a value of negative voltage (about −600V to −800V) relative to the voltage applied to the charger (about −3KV to −4KV), and there is caused the generation of ozone, nitrogen oxide, etc. In order to eliminate such drawbacks has been proposed a contact charging method which employs the charging voltage of a relatively small negative value (about −1.2KV to −1.5KV) compared to the Scotron method and almost does not cause generation of ozone.

Describing the electrophotographic process with reference to FIG. 1 for illustrating the engine mechanism of a laser beam printer employing the contact charging method, a conductive roll 10 is used as a contact charger charged with a negative charging voltage Vch, which in turn charges the photosensitive drum 12 with a negative voltage by contacting. In this way, the surface potential of the photosensitive drum 12 comes to have a negative voltage of about −500V. In the second step of exposing, a laser beam or LED head 14 is used to expose the surface portions of the photosensitive drum 12 corresponding to the configuration of a printed image to form an electrostatic latent image. The exposed portions undergo potential changes but the other portions remain unchanged so as to generate potential differences, which form the latent image.

In the third step of developing the latent image formed on the surface of the photosensitive drum 12, the magnetic roll 16 of the developing section is charged with a negative developing voltage Vd of about −450V to charge the toner in the toner hopper with a negative voltage, which toner is delivered to the developing region by means of rotation of a sleeve. In this case, a regulation blade 18 regulates the amount of the toner and carrier delivered. Additionally moved to the developing region is the toner of opposite polarity (+) which is charged undesirably with a positive charge. The toner delivered to the developing region is partly transferred to the exposed portions of the photosensitive drum 12 developed.

In the fourth step of transferring the developed image of the photosensitive drum 12 to a paper sheet, the transferring means 20 is charged with a transferring voltage Vt of about 800V to 1500V to generate positive charges attached to the sheet (S) Then, the toner particles are deposited on the sheet (S) leaving the transferring means 20 for the fixing stage since the attractive force between the positive charges generated by means of the transferring voltage Vt and the negatively charged toner particles attached to the photosensitive drum 12 is greater than that between the toner particles and the drum 12. In the fifth step of fixing, the toner particles are fixed on the sheet (S) pressed between a pressure roll 26 and heat roll 28. Thereafter, the sheet (S) is discharged out.

Meanwhile, a transfer roll 22 transfers the sheet (S) picked up by a pickup roll (not shown) to a register roll 24 to align it in register. Additionally provided in a laser beam printer is a sensor for sensing the operational conditions of the component parts thereof and transferring condition of the sheet. Referring to FIG. 1, a sensor S1 is provided to monitor the transferring condition of the sheet between the transfer roll 22 and register roll 24, and a sensor S2 provided behind the pressure roll 26 to monitor the state of the sheet discharged by the discharge roll.

In such electrophotographic process, while most of the negatively charged toner particles attached to the photosensitive drum 12 are transferred to the sheet (S) in the transferring step, the toner particles of opposite polarity, i.e., the positively charged particles, remain attached to the photosensitive drum 12, so that a long-term use of the printer causes the accumulation of the positively charged toner particles on the negatively charged conductive roll 10. Consequently, the negative value of the charging voltage Vch of the conductive roll 10 becomes smaller than the initially set value so as to decrease the negative value of the surface potential of the photosensitive drum 12 deteriorating the printed image quality such as causing a speckled image.

SUMMARY OF THE INVENTION

It is an object of the present invention to provide a method for cleaning the contact charger of an electrophotograpic apparatus contaminated with the toner particles of opposite polarity.

According to an embodiment of the present invention, there is provided a method for cleaning the contact charger of an electrophotographic apparatus including a photosensitive (photoconductive) drum, developing means, transfer means and main motor, which comprises the steps of:

applying a charging voltage of a specified level to the contact charger to make the surface of the photosensitive drum keep a surface potential of a given level during rotation of the main motor;

cutting off the charging voltage applied to the contact charger and developing voltage applied to the developing means after a specified time so as to transfer the toner of opposite polarity attached to the contact charger to the photosensitive drum; and applying a negative transfer voltage to the transfer means so as to transfer the toner of opposite polarity transferred to the photosensitive drum to a sheet of paper.

The present invention will now be described with reference to the drawings attached only by way of example.

DETAILED DESCRIPTION OF THE PREFERRED EMBODIMENT

Figure 1:
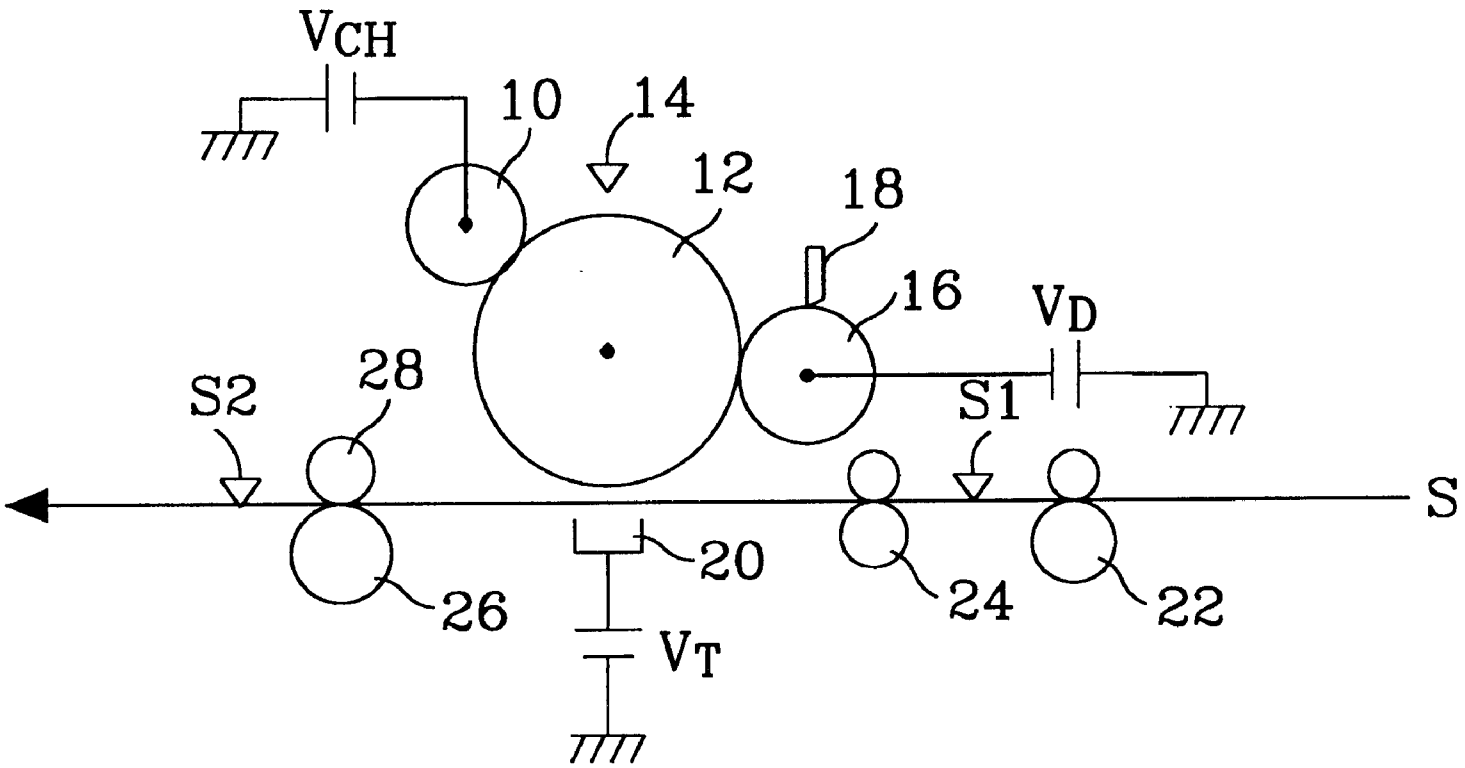
FIG. 1 is a schematic diagram for illustrating the structure of a laser beam printer performing the electrophotographic processing.
Figure 2:
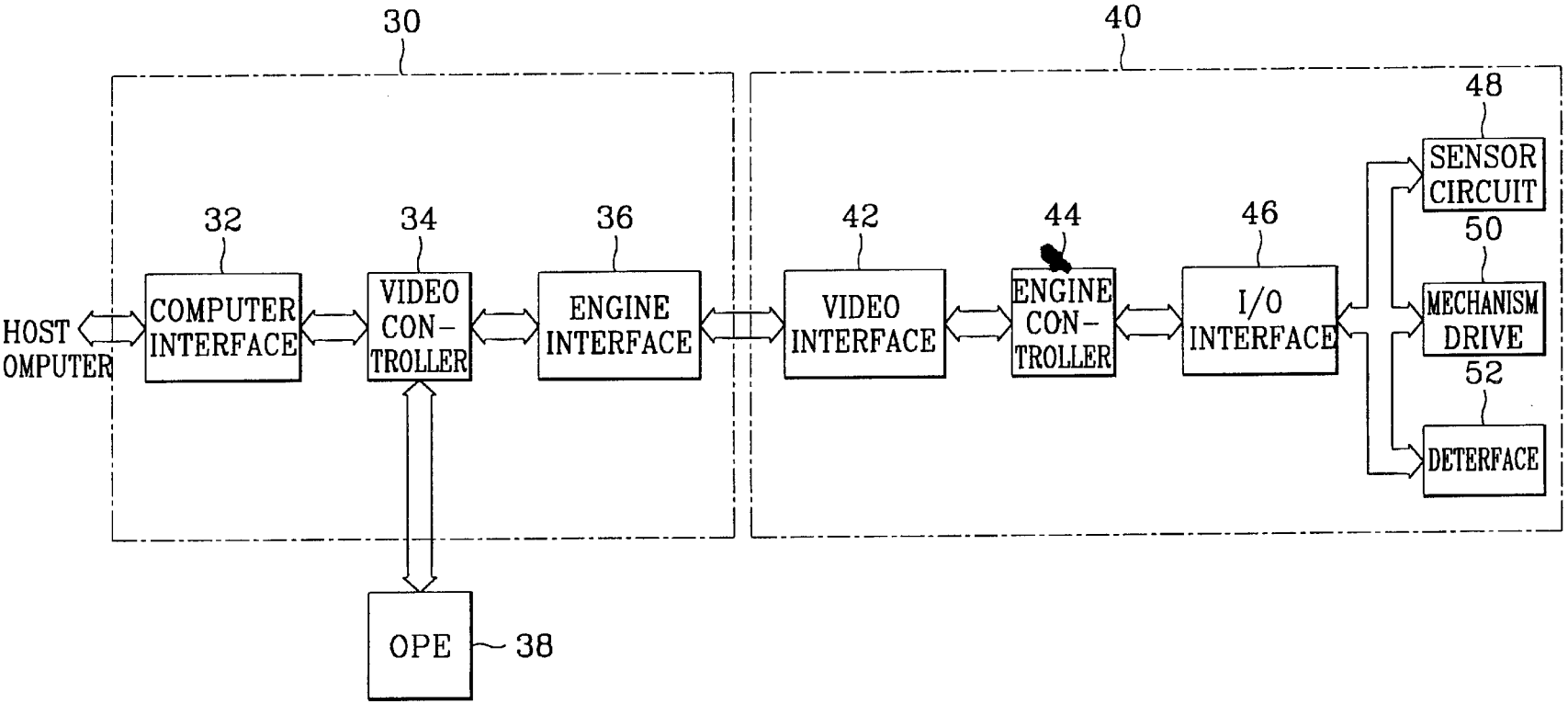
FIG. 2 is a block diagram for illustrating the operational concept of a conventional laser beam printer.

Referring to FIG. 2, the laser beam printer generally includes a video control part 30, print engine part 40, and operation panel equipment (OPE) 38. The video control part 30 includes a computer interface 32, video controller 34, and engine interface 36. The computer interface 32 is to interface a host computer and the video controller 34. The video controller 34 includes a read-only memory (ROM) containing a control program and random access memory device (RAM) for temporarily storing the data from the host computer and OPE 38, so as to convert the data codes received from the computer interface 32 into image data transferred to the print engine part 40. The engine interface 36 interfaces the print engine part 40 under the control of the video controller 34. The OPE 38 is provided with a plurality of keys for inputting various commands and a display for displaying the informations concerning the printer operation, controlled by the video controller 34.

The printer engine part 40 is connected to the video control part 30 including a video interface 42, engine controller 44, I/O (input/output) interface 46, sensor circuit 48, mechanism drive 50, and developer 52. The video interface 42 is to interface the video control part and the engine controller 44, which controls the mechanism drive 50 and developer to print an image on paper according to the image data received from the video control part 30. The engine controller 44 controls the various operations of the engine part 40 (e.g., supplying and transferring sheets of paper) sensed by the sensor circuit 48. The I/O interface 46 is to interface the engine controller 44 with the sensor circuit 48, mechanism drive 50 and developer 52. The sensor circuit 48 works various sensors for detecting the operations of the print engine part 40, supplying and transferring of the sheets, the amount of a developing agent, etc., transferring the detected signals to the engine controller 44. The mechanism drive 50 drives the various mechanisms for supplying, transferring, and printing the sheets. The developer 52 is to print an image on paper according to the image data under the control of the engine controller 44.

Figure 3A:
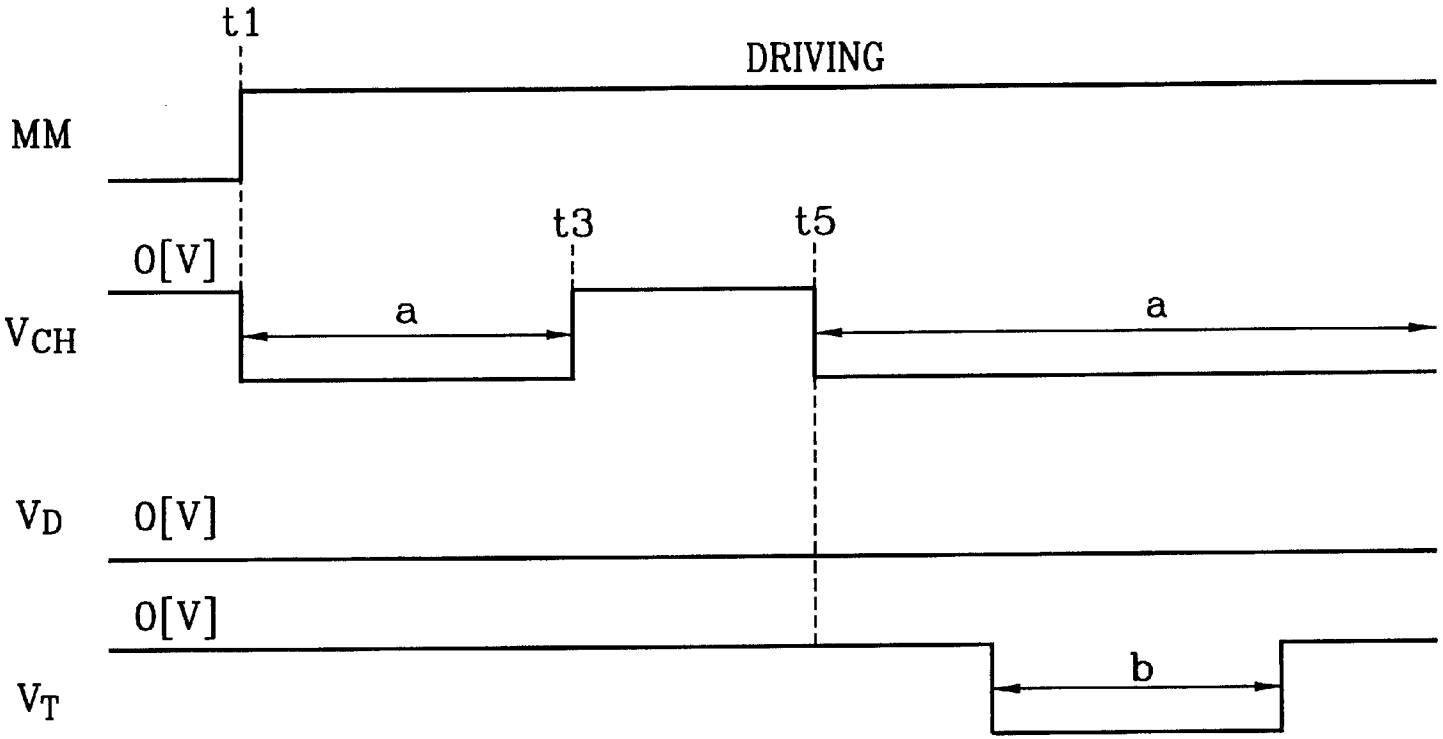
FIGS. 3A to 3C are the timing diagrams for respectively illustrating the charging voltage Vch, developing voltage Vd, and transferring voltage Vt applied to clean the contact charger.
Figure 3B:
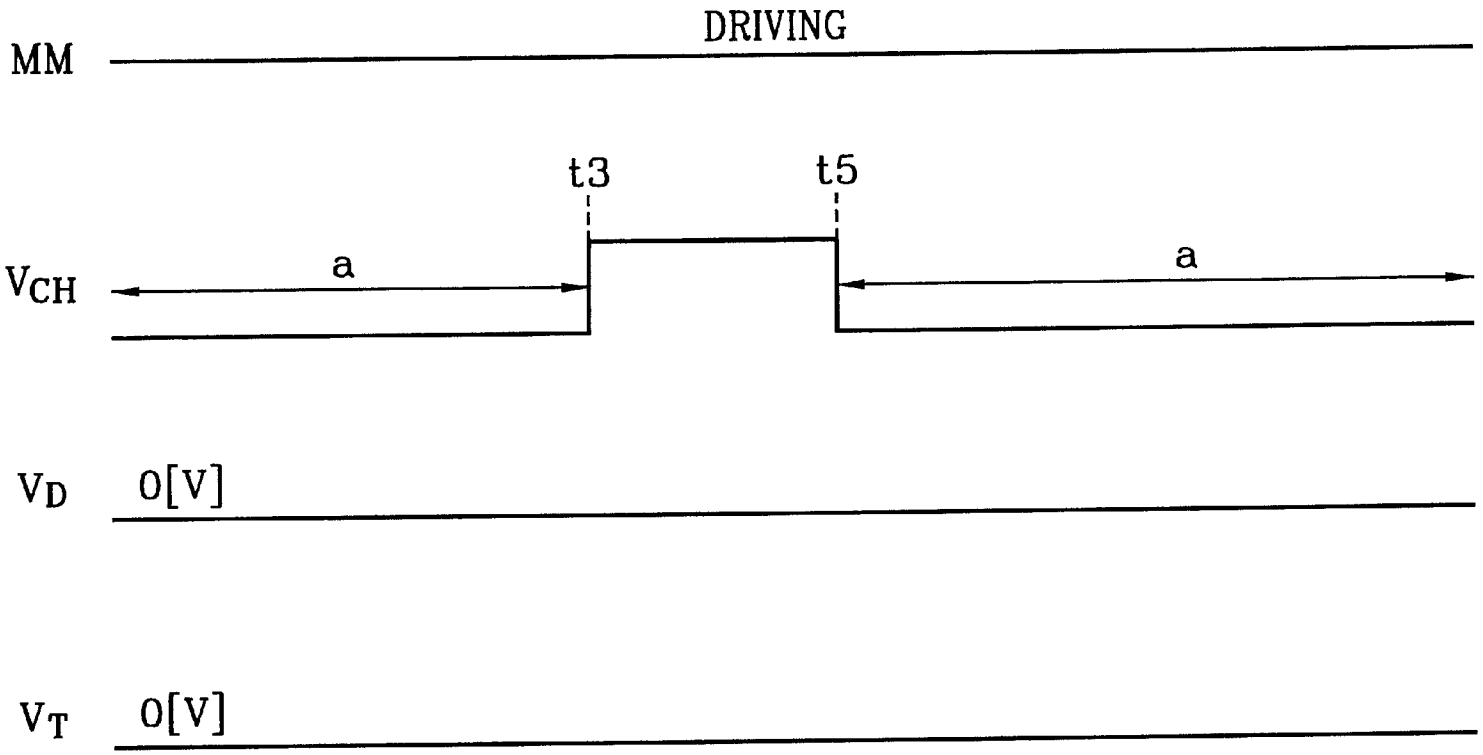
Figure 3C:
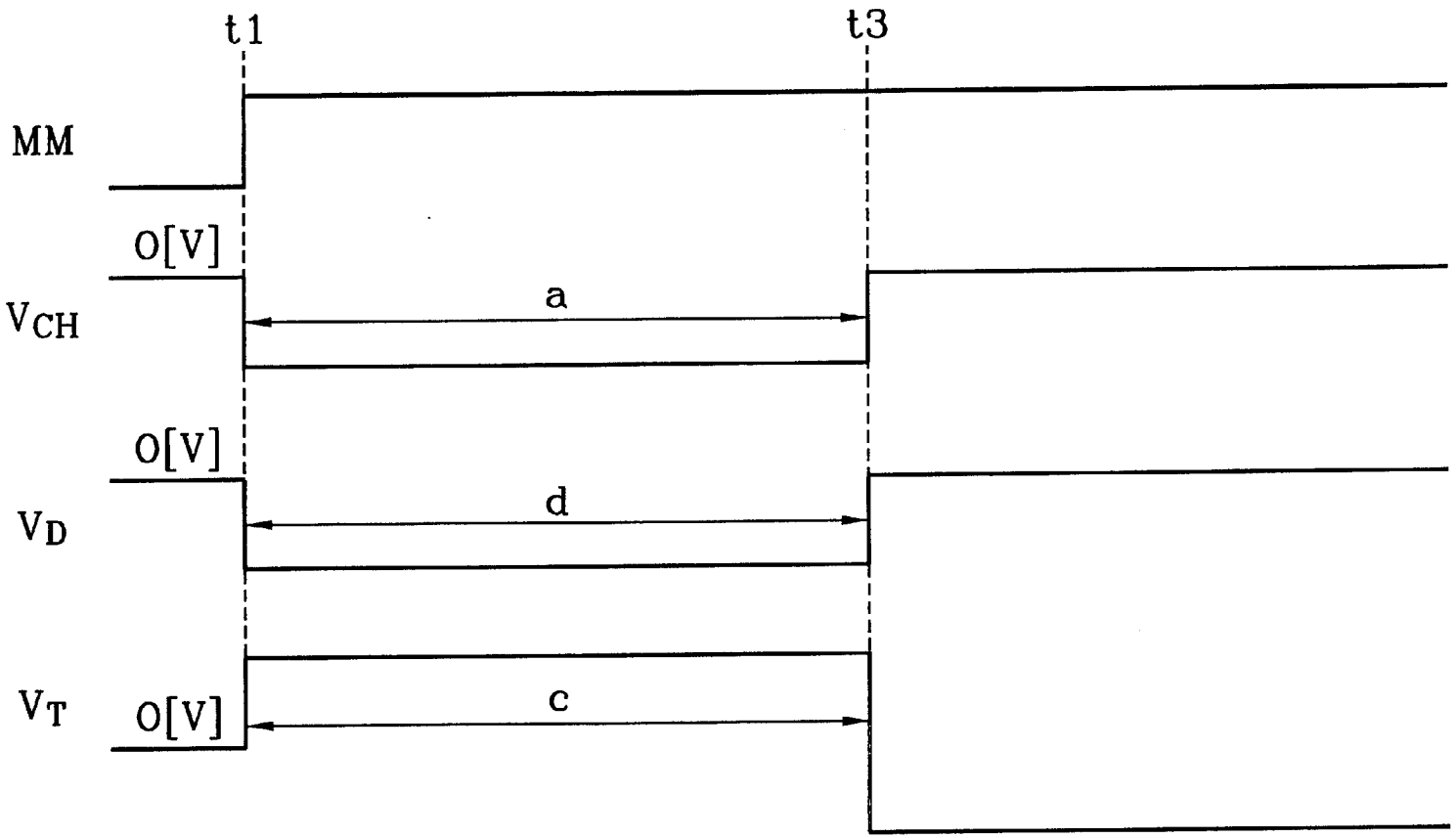

FIGS. 3A to 3C illustrate the timing of applying the charging voltage Vch, developing voltage Vd and transferring voltage Vt to remove the toner of opposite polarity (+) attached to the conductive roll 10. Reference symbol "MM" represents the timing for rotating the main motor of the laser beam printer, and Vch the timing for applying the charging voltage to the conductive roll 10. In the timing diagram of Vch, reference symbol "a" represents an interval for applying the negative charging voltage Vch to the conductive roll 10, and t3–t5 an interval for cutting off the charging voltage Vch from the conductive roll 10. Reference symbols Vd and Vt respectively represent the timings for applying the developing voltage and transferring voltage to the magnetic roll 16 of the developer and transferring means 20. Reference symbol "d" represents an interval for applying the negative developing voltage Vd, and "b" and "c" intervals for respectively applying the positive and the negative transferring voltage Vt.

Describing the control of the video controller 14 to clean the toner of positive polarity attached to the conductive roll 10 with reference to FIG. 3A, when the conductive roll 10 is contaminated by the toner of positive polarity, the video controller 34 firstly starts the clear mode to clear the conductive roll 10 in response to a cleaning key input provided in the OPE 38, driving the main motor at the time t1. Accordingly a sheet of paper is conveyed from the cassette by the pickup roll. Meanwhile, the conductive roll 10 is charged with the charging voltage of about −1.2KV for the interval "a" under the control of the video controller 34, so that the surface of the photosensitive drum 12 is charged with a negative voltage of about −600V. Simultaneously in the interval "a", the video controller 34 cuts off the voltages Vd and Vt from the magnetic roll 16 and transferring means 20.

Thereafter, the video controller 34 cuts off the charging voltage Vch from the conductive roll 10 at the time of t3 preferably after the roll 10 has been rotated more than once. Namely, referring to FIG. 3A, the charging voltage Vch is cut off for the interval from t3 to t5, during which it is assumed that the roll 10 has been rotated more than once. Moreover, the video controller 34 controls a negative transferring voltage Vt to be applied to the transferring means 20 for the interval "b" after the time of t5. In this case, the interval "b" is set longer than the time of cutting off the charging voltage Vch so that the toner of positive polarity may be sufficiently transferred to the paper.

Accordingly, the toner of positive polarity is transferred from the conductive roll 10 to the photosensitive drum 12 charged with the negative voltage of about −500V because the charging voltage Vch is cut off from the conductive roll 10. Then the toner of positive polarity travels along with the photosensitive drum 12 into the transferring section, transferred to the conveyed paper by the negative transferring voltage Vt. Namely, the video controller 34 repeatedly controls the potential difference between the charging voltage Vch and transferring voltage Vt respectively applied to the conductive roll 10 and transferring means 20 so as to remove the toner of opposite polarity (+) from the conductive roll 10, thus preventing the printed image from being speckled.

Alternatively, if it is set that the cleaning operation must be performed after printing a given number of sheets, for example, 200 sheets, the video controller 34 firstly counts the number of the discharged printed sheets to the set value before starting the cleaning operation. Then, it changes the operational mode from the printing mode to the cleaning mode. Meanwhile, the main motor is kept driven to convey the sheets loaded in the cassette by means of the pickup roll. In the interval "a", the video controller 34 makes the conductive roll 10 be charged with a negative charging voltage of about −1.2KV, and keeps the developing voltage Vd and transferring voltage Vt cut off respectively from the magnetic roll 16 of the developer and transferring means 20. Thereafter, the video controller 34 cuts off the charging voltage Vch from the conductive roll 10 at the time of t3. Consequently, the toner of positive polarity is transferred from the conductive roll 10 to the photosensitive drum 12 because the charging voltage Vch is cut off from the conductive roll 10 to lose the negative potential attracting the toner of positive polarity.

Thereafter, the toner of positive polarity is traveled along with the photosensitive drum 12 into the developing section. Meanwhile, the video controller 34 controls the conductive roll 10 to be charged with the charging voltage of about −1.2KV, so that the toner attached to the photosensitive drum 12 is converted from the abnormal positively charged state into a normal negatively charged state collected by the magnetic roll 16 due to the potential difference with the photosensitive drum 12. Consequently, the toner of abnormal positive polarity is removed from the conductive roll 10 preventing the printed image from being speckled.

FIG. 3C illustrates the timings for applying the charging, developing and transferring voltages Vch, Vd and Vt to remove the toner of positive polarity by using a jammed sheet. Firstly, the video controller 34 controls the conductive roll 10, magnetic roll 17 and transferring roll 20 to be sequentially charged with the negative and positive charging voltage from the time of t1. In the present embodiment, it is assumed that the charging, developing and transferring voltage Vch, Vd and Vt are applied at the same time of t1. If a jam occurs in the sheet supplying region or toner transferring region at the time of t3, the video controller 34 converts the printing mode to the cleaning mode cutting off the charging and transferring voltage Vch and Vd respectively from the conductive roll 10 and magnetic roll 16 at the time of t3 (the time point may be slightly different) while changing the transferring voltage applied to the transferring means 20 from positive state to negative state.

Consequently, the toner of positive polarity is moved from the conductive roll 10 to the photosensitive drum 12 traveled along with it to the transferring section. Then, the toner of positive polarity is transferred by the negative transferring voltage Vt from the photosensitive drum 12 to the jammed sheet delivered by the rotation of the main motor. Namely, as described above, the video controller 34 reverses the polarities of the charging and transferring voltages Vch and Vt respectively applied to the conductive roll 10 and transferring means 20 at the time of jamming, thereby removing the toner of abnormal positive polarity from the conductive roll 10.

Thus, the present invention provides an electrophotographic apparatus with means for cleaning the contact charger of the toner of positive polarity by controlling the potential difference between the charging and the transferring voltage respectively applied to the contact charger and transferring means.

Although the present invention has been described in connection with the preferred embodiments, it will be apparent to those skilled in this art that various modifications may be made to them without departing the scope of the appended claims.

What is claimed is:

1. A method for removing positively charged toner particles from a contact charger of an electrophotographic apparatus, comprising the steps of:

sending a signal representing a contact charger cleaning command to a controller in response to manual manipulations by a user of an operation panel on the electrophotographic apparatus having a photosensitive drum, said contact charger, a developer, and a transfer unit, said controller initiating a contact charger charger cleaning operation in response to receiving said signal, said contact charger cleaning operation comprising the steps of:

applying a negative charging voltage in the range of approximately about −1.2 kilovolts to approximately about −1.5 kilovolts to said contact charger to generate a voltage in the range of approximately about −500 volts to approximately about −600 volts on a surface of said photosensitive drum;

cutting off said charging voltage being applied to said contact charger and brining said contact charger to a neutral charge to transfer the positively charged toner from said contact charger to said photosensitive drum bearing a negative voltage;

applying a negative transfer voltage on said transfer unit to transfer the positively changed toner from said photosensitive drum to a sheet of paper;

said contact charger cleaning operation reducing the amount of ozone generated due to the voltage employed by the process.

2. A method as defined in claim 1, wherein the first and second step are performed before stopping of said main motor.

3. A method as defined in claim 2, wherein said specified time represents a duration for said photosensitive drum to rotate more than one cycle.

4. A method for cleaning positively charged toner particles from a contact charger of an electrophotographic apparatus, comprising the steps of:

checking a document counter to determine if a predetermined quantity of documents have been processed by the electrophotographic apparatus having a photosensitive drum, a developer roller, and a transfer unit;

when said predetermined quantity of documents has been processed, performing the steps of:

applying a charging voltage of approximately −1.2 kilovolts to approximately about −1.5 kilovolts to said contact charger to generate a voltage of approximately about −500 volts to approximately about −600 volts on a surface of said photosensitive drum;

cutting off said charging voltage applied to said contact charger to cause said contact charger to bear a neutral charge resulting in the positively charged toner particles transferring to photosensitive drum;

applying a negative charge to said developing roller to transfer the positively charged toner particles from said photosensitive drum to said developing roll; and the positively charged toner particles being transferred from said contact charger to a developer unit while reducing the amount of ozone produced due to the voltages employed said electrophotographic apparatus.

5. A method for cleaning the contact charger of an electrophotographic apparatus, comprising the steps of:

determining whether or not a paper jam has occurred in the electrophotographic apparatus having a photosensitive drum, a developer, and a transfer unit;

cutting off a charging voltage applied to said contact charger during rotation of said main motor to transfer the toner of opposite polarity attached to said contact charger to said photosensitive drum when a paper jam occurs during printing an image according to an externally applied image data; and cutting off the developing voltage applied to said developer while applying a negative transfer voltage to said transfer unit to transfer said toner to the paper.

6. A method as defined in claim 5, wherein said paper jam occurs in the paper supplying or toner transfer region.

7. A method as defined in claim 6, wherein said toner attached to said photosensitive drum is transferred to the jammed paper delivered by the rotation of said main motor.

8. A method as defined in claim 7, wherein the cutting off of said charging voltage and developing voltage is simultaneous with the applying of said negative transfer voltage.

* * * * *